US006985678B2

(12) United States Patent
Maebashi et al.

(10) Patent No.: US 6,985,678 B2
(45) Date of Patent: Jan. 10, 2006

(54) COLOR IMAGE FORMING APPARATUS AND CONTROL METHOD THEREFOR

(75) Inventors: Yoichiro Maebashi, Tokyo (JP); Tomoaki Nakai, Shizuoka (JP); Hiroki Tezuka, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 56 days.

(21) Appl. No.: 10/653,944

(22) Filed: Sep. 4, 2003

(65) Prior Publication Data

US 2004/0081477 A1 Apr. 29, 2004

(30) Foreign Application Priority Data

Sep. 10, 2002 (JP) ..... 2002-264189

(51) Int. Cl.
*G03G 15/01* (2006.01)
*G03G 15/00* (2006.01)

(52) U.S. Cl. ..... 399/39; 399/49

(58) Field of Classification Search ..... 399/15, 399/28, 39, 40, 41, 49, 53, 60
See application file for complete search history.

(56) References Cited

U.S. PATENT DOCUMENTS

| | | | | |
|---|---|---|---|---|
| 5,294,959 A | | 3/1994 | Nagao et al. | |
| 5,343,282 A | * | 8/1994 | Kazaki et al. | 399/39 |
| 5,604,567 A | | 2/1997 | Dundas et al. | 399/39 |
| 5,666,588 A | | 9/1997 | Uchiyama et al. | 399/44 |
| 5,873,010 A | | 2/1999 | Enomoto et al. | 399/39 |
| 5,963,756 A | * | 10/1999 | Sakai et al. | 399/39 |
| 6,008,907 A | | 12/1999 | Vigneau et al. | 358/1.9 |
| 6,029,021 A | | 2/2000 | Nishimura et al. | 399/49 |
| 6,070,022 A | | 5/2000 | Kobayashi et al. | 399/12 |
| 6,075,621 A | | 6/2000 | Takeuchi et al. | 358/461 |
| 6,148,158 A | | 11/2000 | Amemiya | 399/39 |
| 6,172,771 B1 | | 1/2001 | Ikeda et al. | 358/406 |
| 6,185,386 B1 | * | 2/2001 | Noguchi | 399/49 |
| 6,215,562 B1 | | 4/2001 | Michel | 358/1.9 |
| 6,226,466 B1 | | 5/2001 | Ojima et al. | 399/49 |
| 6,450,606 B1 | | 9/2002 | Kato et al. | 347/19 |
| 6,505,010 B1 | * | 1/2003 | Izumizaki et al. | 399/39 |
| 6,750,892 B2 | * | 6/2004 | Suzuki | 399/49 X |
| 6,853,815 B2 | | 2/2005 | Tezuka et al. | 399/39 |
| 2003/0090693 A1 | | 5/2003 | Tezuka et al. | 358/1.9 |

FOREIGN PATENT DOCUMENTS

WO WO 93/20648 10/1993

* cited by examiner

*Primary Examiner*—Sandra L. Brase
(74) *Attorney, Agent, or Firm*—Fitzpatrick, Cella, Harper & Scinto

(57) ABSTRACT

A color image forming apparatus and related method forms a color image on a transfer material. The apparatus is provided with a first optical sensor capable of detecting optical reflection characteristics of an unfixed toner image and a second optical sensor capable of detecting optical reflection characteristics of a toner image after fixation. A first forming step forms a mixed-color toner image including plural toners. A calculation step calculates, based on optical reflection characteristics of the mixed-color toner image detected by the second optical sensor, a condition that the mixed-color toner image becomes achromatic. A second forming step forms a toner image corresponding to the calculated toner mixing ratio. A processing step processes an output of the first optical sensor based on the optical reflection characteristics of the monochromatic toner image detected by the first optical sensor.

22 Claims, 13 Drawing Sheets

| PATCH NO. | C TONALITY | M TONALITY | Y TONALITY | K TONALITY |
|---|---|---|---|---|
| 1 | Cn− α | Mn− α | Yn− α | 0 |
| 2 | Cn+ α | Mn− α | Yn− α | 0 |
| 3 | Cn− α | Mn+ α | Yn− α | 0 |
| 4 | Cn− α | Mn− α | Yn+ α | 0 |
| 5 | Cn+ α | Mn+ α | Yn− α | 0 |
| 6 | Cn+ α | Mn− α | Yn+ α | 0 |
| 7 | Cn− α | Mn+ α | Yn+ α | 0 |
| 8 | Cn+ α | Mn+ α | Yn+ α | 0 |
| 9 | 0 | 0 | 0 | Kn |

COLOR IMAGE FORMING APPARATUS AND CONTROL METHOD THEREFOR

BACKGROUND OF THE INVENTION

1. Field of the Invention

The present invention relates to a color image forming apparatus of an electrophotographic process such as a color printer or a color copying apparatus, and a control method therefor.

2. Related Background Art

For the color image forming apparatus employing an electrophotographic process or an ink jet process such as a color printer or a color copying apparatus, there is recently required a higher image quality for the output image. In particular, a density gradation and stability thereof influence significantly on the human judgment whether an image is good or not.

However, in the color image forming apparatus, an obtained image shows a variation in the density, in case a variation is caused in various units of the apparatus by an environmental change or by a prolonged use. Particularly in a color image forming apparatus of an electrophotographic process, even a slight environmental change may result a density variation leading to an aberration in the color balance, so that there is required means for always maintaining a constant density. There is therefore provided such construction as to form a density detecting toner image (hereinafter called patch) with toner of each color on an intermediate transfer member or a photosensitive member, to detect the density of such unfixed toner patch with an unfixed toner density detecting sensor (hereinafter called density sensor) and to execute a density control by feedback of a result of such detection to process conditions such as an exposure amount, a developing bias, etc., thereby obtaining stable images.

However, the density control utilizing such density sensor is based on detecting a patch formed on the intermediate transfer member or the photosensitive drum, and cannot control an aberration in the color balance resulting from variations in a transfer and a fixation on a transfer material to be executed thereafter. Such variations cannot be coped with the aforementioned density control utilizing the density sensor.

Consequently, there can be conceived a color image forming apparatus equipped with a sensor (hereinafter called color sensor) for detecting a density or color of a patch formed on the transfer material.

Such color sensor is constituted of three or more light sources with different light emission spectra such as light-emitting elements of red (R), green (G) and blue (B) or a light source such as a light-emitting element emitting a white (W) light, and light-receiving elements bearing three or more filters of different spectral transmittances such as of red (R), green (G) and blue (B). In this manner there can be obtained three or more different outputs such as RGB outputs.

However, a control with such color sensor requires a patch formation on the transfer material, thus necessitating consumption of a transfer material and toners. Consequently a frequency of such control cannot be made very high. Such color sensor only is unable to achieve an effective density control while minimizing the frequency of control with such color sensor.

SUMMARY OF THE INVENTION

An object of the present invention is to solve the aforementioned drawbacks.

The above-mentioned object can be attained, according to the present invention, by a color image forming apparatus including:

an image forming unit capable of forming a color image;

a first optical sensor capable of detecting an unfixed toner image;

a second optical sensor capable of detecting a toner image after fixation;

a calculation unit adapted to calculate, based on characteristics of a mixed-color toner image detected by the second optical sensor, a condition that the mixed-color toner image becomes achromatic;

means which causes the image forming unit to form a monochromatic toner image based on a result of calculation by the calculation unit; and a setting unit adapted to set a correcting condition for an output of the first optical sensor, based on a result of detection of the monochromatic toner image detected by the first optical sensor.

According to the present invention, there is also provided a color image forming apparatus including:

an image forming unit capable of forming a color image;

a first optical sensor capable of detecting an unfixed toner image formed by the image forming unit;

a second optical sensor capable of detecting a toner image after fixation, formed in the image forming unit;

a calculation unit adapted to calculate, based on characteristics of a mixed-color toner image detected by the second optical sensor, a condition that the mixed-color toner image becomes achromatic; and a setting unit adapted to set a correcting condition for an output of the first optical sensor, based on a result of calculation by the calculation unit.

According to the present invention, there is also provided a control method for controlling a color image forming apparatus capable of forming a color image and provided with a first optical sensor capable of detecting an unfixed toner image and a second optical sensor capable of detecting a toner image after fixation, the method including:

a calculation step of calculating, based on characteristics of a mixed-color toner image detected by the second optical sensor, a condition that the mixed-color toner image becomes achromatic;

a step of causing the image forming unit to form a monochromatic toner image based on a result of the calculation; and a setting step of setting a correcting condition for an output of the first optical sensor, based on a result of detection of the monochromatic toner image detected by the first optical sensor.

According to the present invention, there is also provided a control method for a color image forming apparatus capable of forming a color image and provided with a first optical sensor capable of detecting an unfixed toner image and a second optical sensor capable of detecting a toner image after fixation, the method including:

a calculation step of calculating, based on characteristics of a mixed-color toner image detected by the second optical sensor, a condition that the mixed-color toner image becomes achromatic; and a setting step of setting a correcting condition for an output of the first optical sensor, based on a result of the calculation.

Still other objects and configurations of the present invention, and advantages thereof, will become fully apparent from the following detailed description which is to be taken in conjunction with accompanying drawings.

DESCRIPTION OF THE PREFERRED EMBODIMENTS (First Embodiment)

Figure 1:
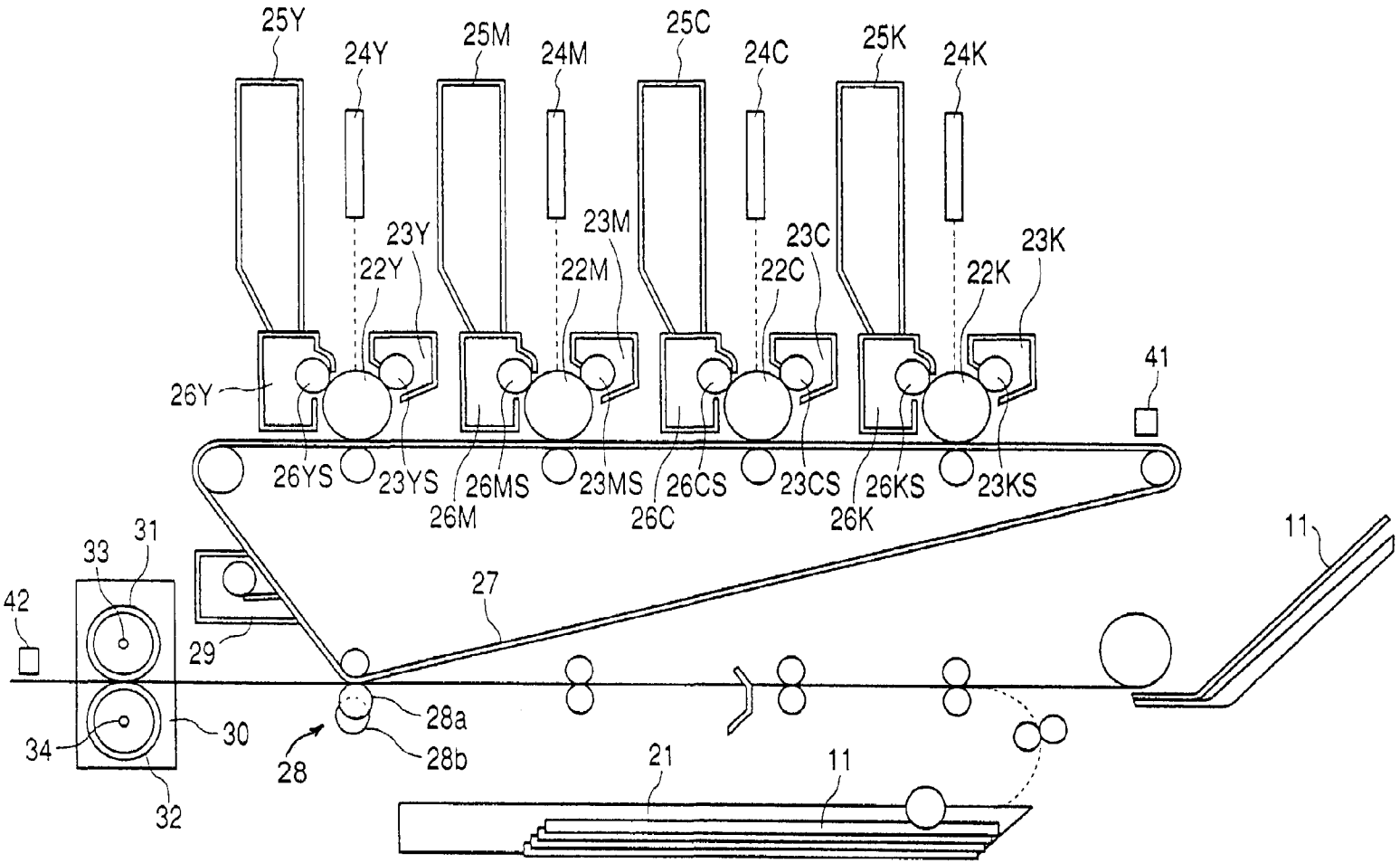
FIG. 1 is a cross-sectional view showing an entire configuration of a first embodiment of the present invention.

FIG. 1 is a cross-sectional view showing an entire configuration of a color image forming apparatus in a first embodiment. As shown in the drawing, the apparatus is a color image forming apparatus of a tandem type, employing an intermediate transfer member (mid transfer material) 27, as an electrophotographic color image forming apparatus. The present color image forming apparatus is composed of an image forming unit shown in FIG. 1 and an unrepresented image processing unit.

In the following, there will be explained, with reference to FIG. 1, an operation of the image forming unit in the electrophotographic color image forming apparatus. The image forming unit serves to form electrostatic latent images by exposing lights turned on based on exposure times converted by the image processing unit, developing such electrostatic latent images to form monochromatic toner images, superposing such monochromatic toner images to form a multi-color toner image, transferring such multi-color toner image onto a transfer material 11 and fixing such multi-color toner image on a transfer material 11, and is constituted of a paper feed unit 21; a photosensitive member (22Y, 22M, 22C, 22K), injection charging means (23Y, 23M, 23C, 23K) as primary charging means, a toner cartridge (25Y, 25M, 25C, 25K) and developing means (26Y, 26M, 26C, 26K) which are provided for each of stations provided by a number of colors to be developed; an intermediate transfer member 27; a transfer roller 28; cleaning means 29; a fixing unit 30; a density sensor 41 and a color sensor 42.

Each of the photosensitive drums (photosensitive members) 22Y, 22M, 22C, 22K is formed by coating an organic photoconductive layer on an external periphery of an aluminum cylinder, and is rotated by a driving force of an unrepresented driving motor, which rotates the photosensitive drums 22Y, 22M, 22C, 22K in a counterclockwise direction in the course of an image forming operation.

As primary charging means, the stations are respectively provided, for charging the photosensitive members of yellow (Y), magenta (M), cyan (C) and black (K), with four injection chargers 23Y, 23M, 23C, 23K, which are respectively provided with sleeves 23YS, 23MS, 23CS, 23KS.

Exposing lights to the photosensitive drums 22Y, 22M, 22C, 22K are supplied from scanner units 24Y, 24M, 24C, 24K and selectively expose the surfaces of the photosensitive drums 22Y, 22M, 22C, 22K, thereby forming electrostatic latent images.

As developing means for rending the electrostatic latent images visible, the stations are respectively provided with four developing devices 26Y, 26M, 26C, 26K, which respectively execute development of yellow (Y), magenta (M), cyan (C) and black (K) colors, and which are respectively provided with sleeves 26YS, 26MS, 26CS, 26KS. Each developing device is detachably mounted.

An intermediate transfer member 27 is in contact with the photosensitive drums 22Y, 22M, 22C, 22K and is rotated clockwise at the image formation along with the rotation of the photosensitive drums 22Y, 22M, 22C, 22K, thereby receiving transfers of monochromatic images. Thereafter a transfer roller 28 to be explained later is brought into contact with and supports the intermediate transfer member 27 thereby transferring a multi-color toner image thereon onto the transfer material 11.

A transfer roller 28 is maintained in a position 28*a* in contact with the transfer material 11 during the transfer of the multi-color toner image, but is separated to a position 28*b* after the printing process.

A fixing unit 30 serves to fix the transferred multi-color toner image by fusion while the transfer material 11 is conveyed, and is provided, as shown in FIG. 1, with a fixing roller 31 for heating the transfer material 11 and a pressure roller 32 for contacting the transfer material 11 with the fixing roller 31 under a pressure. The fixing roller 31 and the pressure roller 32 have a hollow structure and are provided therein with heaters 33, 34 respectively. Thus the transfer material 11 bearing the multi-color toner image is conveyed by the fixing roller 31 and the pressure roller 32 and is given a heat and a pressure, whereby the toner is fixed to the surface.

The transfer material 11 after the fixation of the toner image is thereafter discharged by unrepresented discharge rollers onto an unrepresented discharge tray, whereupon the image forming operation is terminated.

Cleaning means 29 serves to remove toner remaining on the intermediate transfer member 27, and used toner remaining after the transfer of the four-color toner image formed on the intermediate transfer member 27 is stored in a cleaner container.

Figure 2:
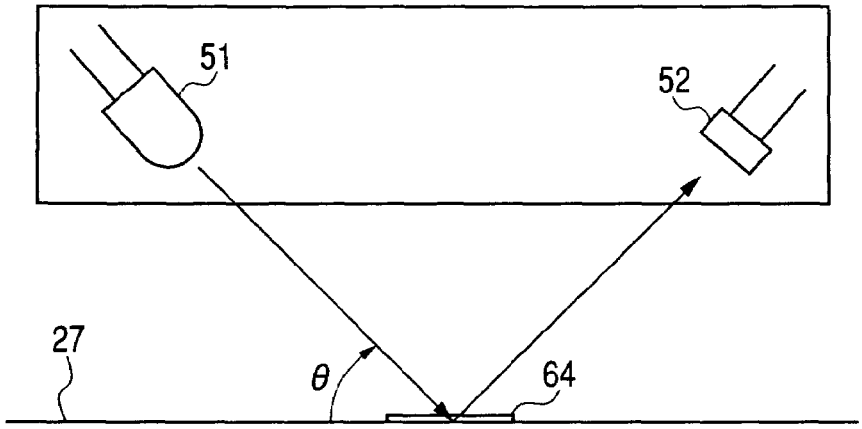
FIG. 2 is a view showing a configuration of a density sensor 41 in the present invention.

A density sensor 41 in the color image forming apparatus shown in FIG. 1 is positioned toward the intermediate transfer member 27, and measures a density of a patch formed on the surface of the intermediate transfer member 27. The density sensor 41 has a configuration as exemplified in FIG. 2, and is constituted of an infrared light-emitting element 51 such as an LED, a light-receiving element 52 such as a photodiode, an unrepresented IC or the like for processing data of received data, and an unrepresented holder for containing these components.

The infrared light-emitting element 51 is positioned with an angle of 45° to a direction perpendicular to the intermediate transfer member 27, and irradiates a toner patch 64 on the intermediate transfer member 27 with an infrared light. The light-receiving element 52 is provided in a position symmetrical to the light-emitting element 51 and detects a normally reflected light from the toner patch 64.

For coupling the light-emitting element 51 and the light-receiving element 52, there may be employed an optical element such as an unrepresented lens or the like.

In the present embodiment, the intermediate transfer member 27 is formed by a single-layered resinous belt of a polyimide resin, in which an appropriate amount of fine carbon particles are dispersed for regulating a resistance of the belt, and which has a black surface color. The surface of the intermediate transfer member 27 has a high smoothness and is lustrous, with a glossiness of about 100% (measured with a gloss meter IG-320 manufactured by Horiba, Ltd.).

In a state where the surface of the intermediate transfer member 27 is exposed (toner density 0), the light-receiving element 52 of the density sensor 41 detects a reflected light, because the surface of the intermediate transfer member 27 is lustrous as explained before. On the other hand, in case a toner image is formed on the intermediate transfer member 27, the output of normal reflection decreases as the density of the toner image increases. This is because the toner covers the surface of the intermediate transfer member 27, thereby decreasing the normally reflected light from the belt surface.

A color sensor 42 is provided, in the color image forming apparatus shown in FIG. 1, in a downstream position of the fixing unit 30 in a conveying path for the transfer material, so as to be opposed to an image forming surface of the transfer material 11, and detects RGB outputs for a mixed-color patch after fixation, formed on the transfer material. Such positioning inside the color image forming apparatus enables an automatic detection before the image after fixation is discharged to the sheet discharge unit.

Figure 3A:
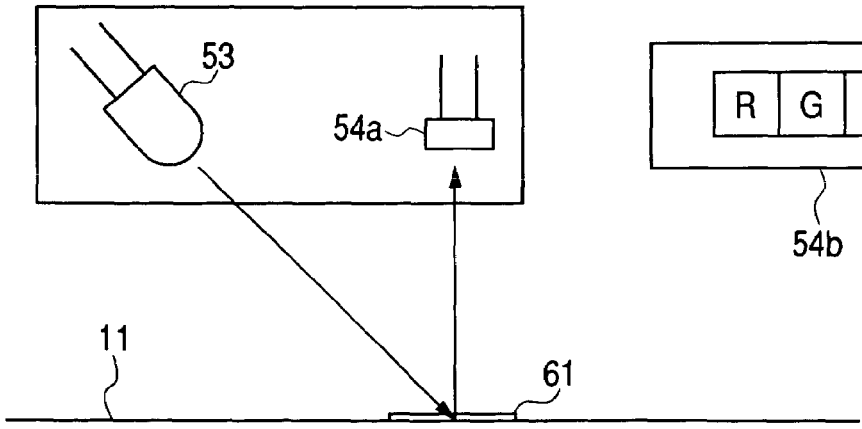
FIGS. 3A and 3B are views showing a configuration of a color sensor 42 in the present invention.
Figure 3B:
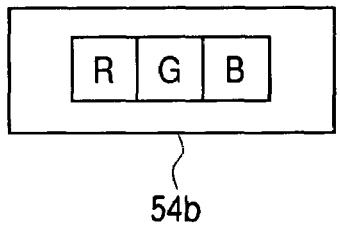

FIGS. 3A and 3B illustrate an example of the configuration of the color sensor 42. The color sensor 42 shown in FIG. 3A is constituted of a white-color LED 53 and a charge-accumulating sensor 54*a* with on-chip RGB filters 54*b*. An output light from the white-color LED 53 is caused to enter, in a direction of an angle of 45°, the transfer material 11 on which a fixed patch 61 is formed, and a random reflectedlight intensity in a direction of an angle of 0° is detected by the charge-accumulating sensor 54*a* with on-chip RGB filters. In the charge-accumulatingsensor 54*a* with on-chip RGB filters, a light-receiving part 54 is provided with independent pixels for R, G and B colors as shown in FIG. 3B.

In the charge-accumulating sensor 54*a* with on-chip RGB filters, the sensor may be composed of photodiodes, or may include several sets each including three RGB pixels. There may also be adopted a configuration with an incident angle of 0° and an exit angle of 45°, or a configuration constituted of LEDs emitting lights of RGB colors and a sensor without color filters.

In the following, an electrical control system of the color image forming apparatus will be explained with reference to FIG. 15.

Figure 15:
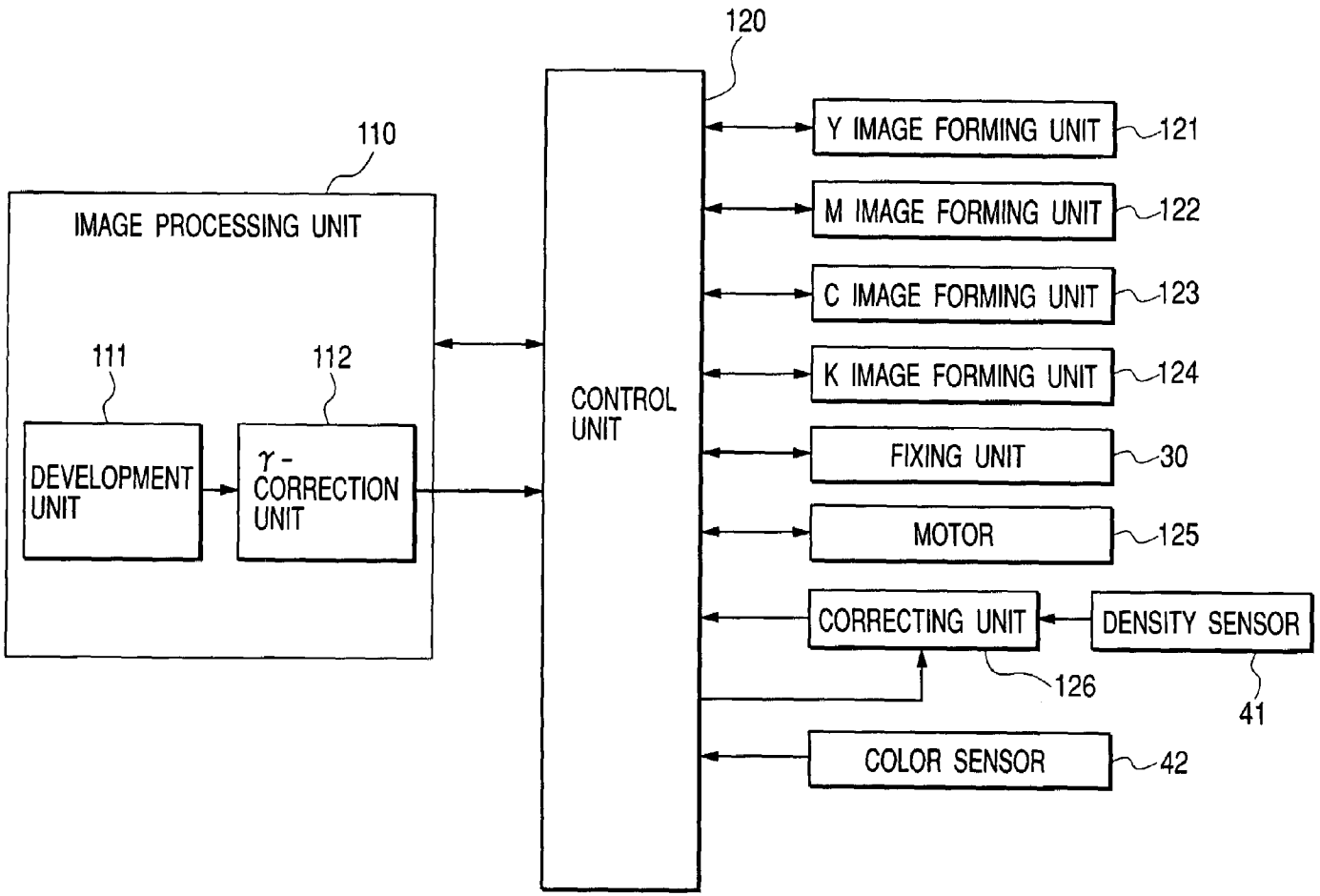
FIG. 15 is a block diagram showing an electrical control system in the color image forming apparatus embodying the present invention.

Referring to FIG. 15, an image processing unit 110 for generating image data is constituted of a development unit 111 for receiving a print job from an unrepresented host computer and developing it into image data, a gamma correction unit 112 for executing various image processes based on internally stored look-up tables for respective colors, etc. There are also provided image forming units 121–124 for forming colored images of yellow, magenta and cyan and an achromatic black image, a fixing unit 30 for fixing a formed image to the transfer material, a motor for driving devices relating to image formation and rollers for conveying the transfer material, and a density sensor 41 and a color sensor 42 explained in the foregoing.

A control unit 120 controls the aforementioned color image forming units 121–124, the fixing unit 30, the motor 125, etc. and causes these units to execute the image formation. The control unit 120 also executes a flowchart to be explained later and various image forming sequences.

A correction unit 126 corrects the output of the density sensor, and a table is set therein by the control unit 120 according to a flowchart to be explained later. The correction table may also be provided in an unrepresented non-volatile memory in the control unit 120.

In the following there will be explained a correction process for the density sensor 41 and a color balance correction control in the present embodiment. In the present embodiment, in order to correct the density sensor 41, it is necessary to utilize the color sensor 42. Stated otherwise, there is required a toner image fixed on the transfer material, so that it is preferable to minimize the frequency of execution of such control. In the present embodiment, the correction control is executed by a manual operation of the user when the user desires an execution of the correction control. It is naturally possible also, as another embodiment, to execute such correction control at a predetermined interval.

Also the present embodiment employs a CMY mixed color patch and a K monochromatic patch as the patch fixed on the transfer material, and corrects the color balance of a process gray color by comparing the CMY mixed color patch and the K monochromatic patch.

This is because, in a color image forming apparatus, in case the color balance becomes unstable, a variation in the hue (or coloring) tends to occur particularly in the process gray color, and the human eyes are sensitive to such variation in the hue. Consequently a correction on the process gray color can realize an effective improvement in the image quality.

Figure 4:
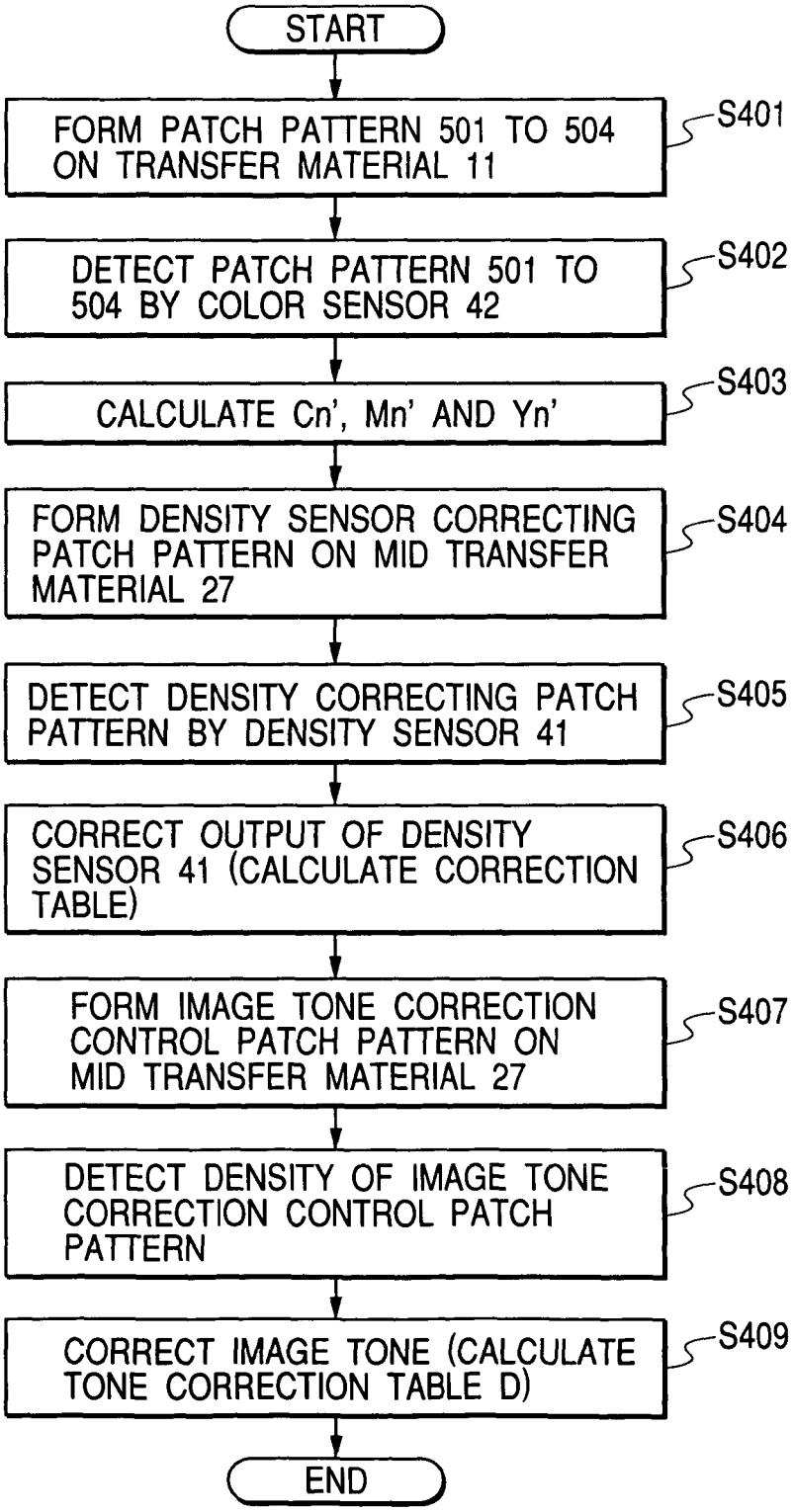
FIG. 4 is a flowchart showing a process in the first embodiment of the present invention.
Figure 5:
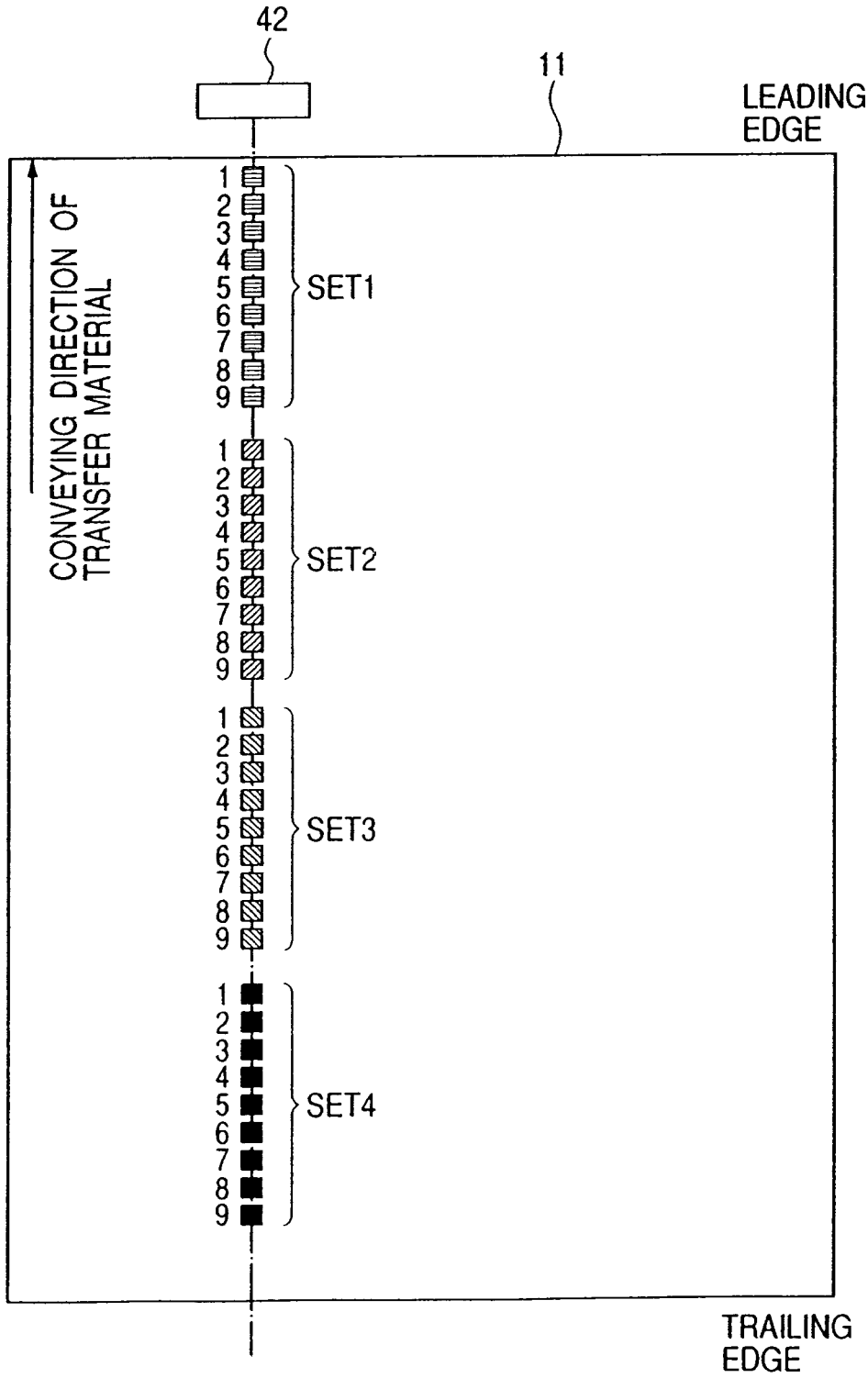
FIG. 5 is a view showing an arrangement of a patch pattern on a transfer material, to be employed in the first embodiment.

In the following there will be explained, with reference to FIGS. 4 and 5, a correction process for the density sensor and a correction process for the color balance in the present embodiment. FIG. 4 is a flowchart of a correction process for the density sensor and a correction process for the color balance in the present embodiment. FIG. 5 is a view showing an example of a patch pattern in the present embodiment.

In the flowchart shown in FIG. 4, at first a step S401 prepares a patch pattern on the transfer material 11.

FIG. 5 shows a patch pattern formed on the transfer material 11 (which, in this case, is A3 size (297×420 mm) conveyed longitudinally). Formed patches are composed of four patch sets (SET1, SET2, SET3, SET4), and each patch set is composed of CMY mixed-color patches 1 to 8 and a K monochromatic patch 9, namely 9 patches in total (each 8 mm square and mutually separated by 2 mm).

Figures 6, 7:
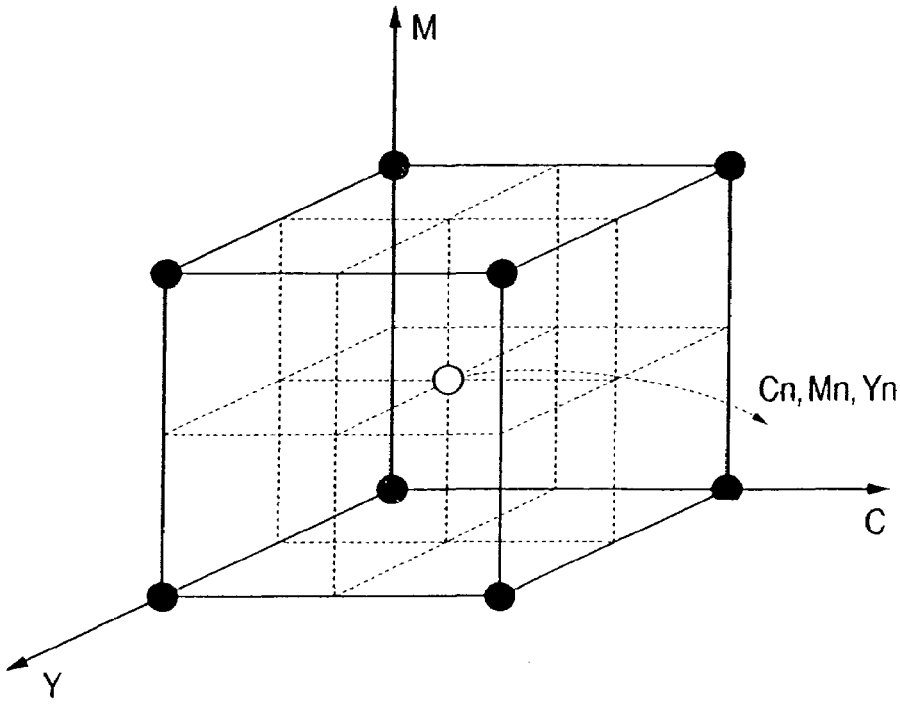
FIG. 6 is a table explaining the patch pattern on the transfer material, to be employed in the first embodiment.
FIG. 7 is a three-dimensional presentation of C, M, Y coordinates of the patches shown in FIG. 6.

The patches 1 to 9 in a same patch set respectively have CMY data 1–8 and K monochromatic data 9 as shown in FIG. 6.

In a patch set SETn (n being 1 to 4), C, M, Y tonalities (tonal levels of image data) corresponding to the patches are a combination of values obtained by changing the tonality by ±α from reference tonalities Cn, Mn, Yn (hereinafter represented as reference values). Also a 9th patch is a K monochromatic patch, formed with a predetermined tonality Kn. The reference values Cn, Mn, Yn and Kn are such that a mixing of Cn, Mn and Yn provides a color same as Kn in a state where the tone-density characteristics of C, M, Y and K are adjusted to a default state (most average state of the apparatus), and are selected in designing of color processing and halftone.

The patch sets SET1–SET4 are formed with different tonality values. For example, the SET1, SET2, SET3 and SET4 are prepared with the tonalities of the Kn (patch 9) respectively at 25%, 50%, 75% and 100%. Also patches 1–8 are prepared with values corresponding to the tonality of Kn (patch 9).

Then, in a step S402, RGB outputs of the patches fixed to the transfer material in the step S401 are detected by the color sensor 42.

Then a step S403 calculates, from the RGB outputs of the sensor, C, M, Y tonality values (mixing ratio) required in order that a process gray color formed by C, M, Y matches the color of the K patch 9.

In case the image forming conditions are identical with those at the designing of color processing, the color of Kn coincides with a color obtained by mixing (Cn, Mn, Yn), but such coincidence does not happen usually and an aberration in color results because of reasons described in the explanation of the prior art. FIG. 7 shows a three-dimensional representation of C, M, Y coordinates of the patches 1–8, wherein the RGB outputs of the patches are represented by 1=(r1, g1, b1), 2=(r2, g2, b2) etc. In FIG. 7, a center of the cubic lattice has coordinate values (Cn, Mn, Yn).

Then, C, M, Y values required to match the RGB values of Kn from the RGB values of the patches 1 to 8 are determined by linear interpolations of 8 points shown in FIG. 7. More specifically, the determination is made by calculating RGB values (Rcmy, Gcmy, Bcmy) for the C, M, Y coordinates in the cubic lattice shown in FIG. 7 according to a following formula:

$$
\begin{aligned}
Rcmy = ((&C - Cn + \alpha)(M - Mn + \alpha)(Y - Yn + \alpha)r1 + \\
&(Cn + \alpha - C)(M - Mn + \alpha)(Y - Yn + \alpha)r2 + \\
&(C - Cn + \alpha)(Mn + \alpha - M)(Y - Yn + \alpha)r3 + \\
&(C - Cn + \alpha)(M - Mn + \alpha)(Yn + \alpha - Y)r4 + \\
&(Cn + \alpha - C)(Mn + \alpha - M)(Y - Yn + \alpha)r5 + \\
&(Cn + \alpha - C)(M - Mn + \alpha)(Yn + \alpha - Y)r6 + \\
&(C - Cn + \alpha)(Mn + \alpha - M)(Yn + \alpha - Y)r7 + \\
&(Cn + \alpha - C)(Mn + \alpha - M)(Yn + \alpha - Y)r8)/(8\alpha 3)
\end{aligned}
$$

Gcmy and Bcmy can be determined by similar formulas.

Then, there is determined a difference between thus calculated (Rcmy, Gcmy, Bcmy) and the RGB values (Rk, Gk, Bk) of K by, for example, squared sum of RGB differences. Then there is determined a smallest difference, namely (Rcmy, Gcmy, Bcmy) closest to (Rk, Gk, Bk) and C, M, Y values in such state are selected as optimum values (Cn', Mn', Yn').

α is selected at an optimum value taking into consideration following two conditions that:

1) the dimension of the cubic lattice should as small as possible in order to increase the precision of interpolation; and
2) in case Kn and (Cn, Mn, Yn) are significantly aberrated, the point (Cn', Mn', Yn') is not present in the vicinity of the cubic lattice center (Cn, Mn, Yn), but it has to be contained in the cubic lattice and the cubic lattice should be large enough for this purpose.

Figure 8:
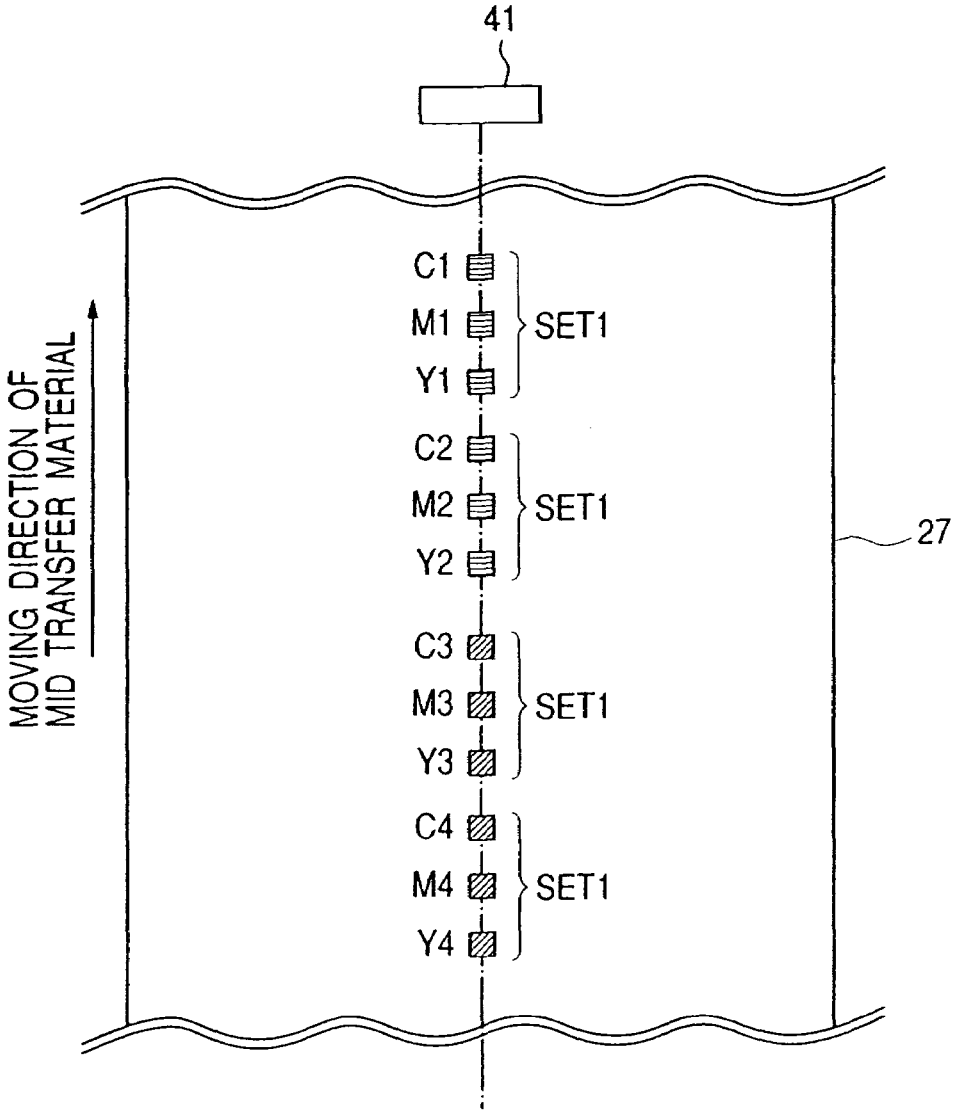
FIG. 8 is a view showing density sensor correcting patches in the first embodiment.

Then a step S404 forms correction patches for the density sensor 41 on the intermediate transfer member 27. FIG. 8 shows a patch pattern to be formed on the intermediate transfer member 27, and, corresponding to the position of the density sensor 41, 8 mm square patches are formed with a gap of 12 mm and, for each of C, M, Y, with an image print rate (density tonality) in 4 levels (4 patches for each color), thus 12 patches in total. The print rates (tonality levels) of the patches correspond to Cn', Mn', Yn' of 4 tonality levels (SET1–SET4) calculated in the step S403. More specifically, C1, M1, Y1 respectively correspond to Cn'1, Mn'1, Yn'1 of the SET1; C2, M2, Y2 respectively correspond to Cn'2, Mn'2, Yn'2 of the SET2; C3, M3, Y3 respectively correspond to Cn'3, Mn'3, Yn'3 of the SET3; and C4, M4, Y4 respectively correspond to Cn'4, Mn'4, Yn'4 of the SET4.

Then a step S405 causes the density sensor 401 to detect the density of the correction patches formed in the step S404. For converting a detection signal of the density sensor 41 into a density, there can be employed, for example, a detection signal-density conversion table (density conversion table) which is already known in the art. Details of such density conversion table will not be explained further.

Then a step S406 sets a correction table for each of YMC color components stored in the correction unit 126 for correcting the output of the density sensor 41.

Figure 9:
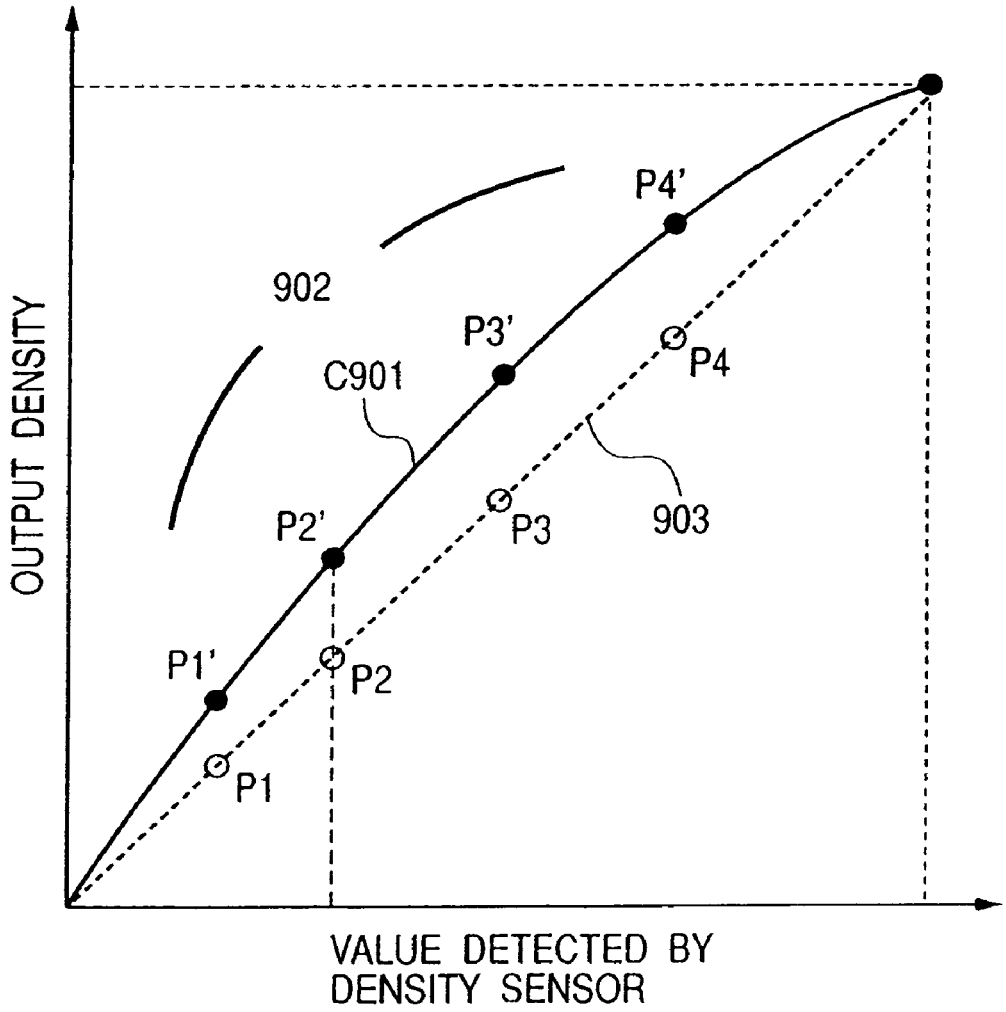
FIG. 9 is a chart showing a correction table for the density sensor 41 in the first embodiment.

In the following there will be explained, with reference to FIG. 9, a correction method for the density sensor 41. FIG. 9 is a chart representing a correction table for correcting the output of the density sensor 41 in the present embodiment. Referring to a chart shown in FIG. 9, the abscissa represents detection values of the density sensor 41 for patches C1, C2, C3 and C4, while the ordinate represents an output density (DCn) corresponding to Cn in each of the 4 tonality values (SET1 to SET4) in the step S401.

In FIG. 9, a curve C901 represents a correction table for the density sensor 41. The correction table C901 passes black circle points (P1' to P4'; each corresponding to an output density for Cn in the step S401 and a detection result of the density sensor 41 in the step S405), and, any density not corresponding to a patch (tonality between patches) is calculated by a spline interpolation of the original point, the points 902 and a point of a maximum output of the density sensor (maximum value of the density conversion table). Thus calculated correction table C901 is used in an image tone control (tone correction) to be explained in a step S407 and thereafter.

In the following, there will be explained, in more specific manner, a correction method for the output density of the density sensor 41, utilizing the correction table C901. A relationship between the detection value of the density sensor 41 and output density prior to correction is represented by a broken line 903, connecting while circle points P1 to P4. Thus, let us consider for example a detection value O2 of the density sensor corresponding to P2' and P2. The output density prior to correction is P2, corresponding to the detection value O2, but the output density can be determined as P2' based on the correction table C901. In this manner it is rendered possible to correct the output density of the density sensor 41.

The correction table C901 is calculated not only for cyan color but also for magenta and yellow colors in a similar manner. The correction table C901 is calculated by an unrepresented CPU in a main body, and is stored in an unrepresented memory in the main body (a non-volatile memory being used in the present embodiment). The correction process for the density sensor 41 in the present embodiment is executed as explained above.

Then, steps S407 to S409 execute an image tone control (tone correction) by detecting reflective characteristics of each of YMCK single-color patches by the density sensor 41 and setting a tone correction table (gamma correction table) for each of YMCK colors stored in a gamma correction unit 112. In the following there will be explained such image tone control (tone correction).

At first a step S407 forms patches for the image tone control (tone correction) on the intermediate transfer member 27.

Figure 10:
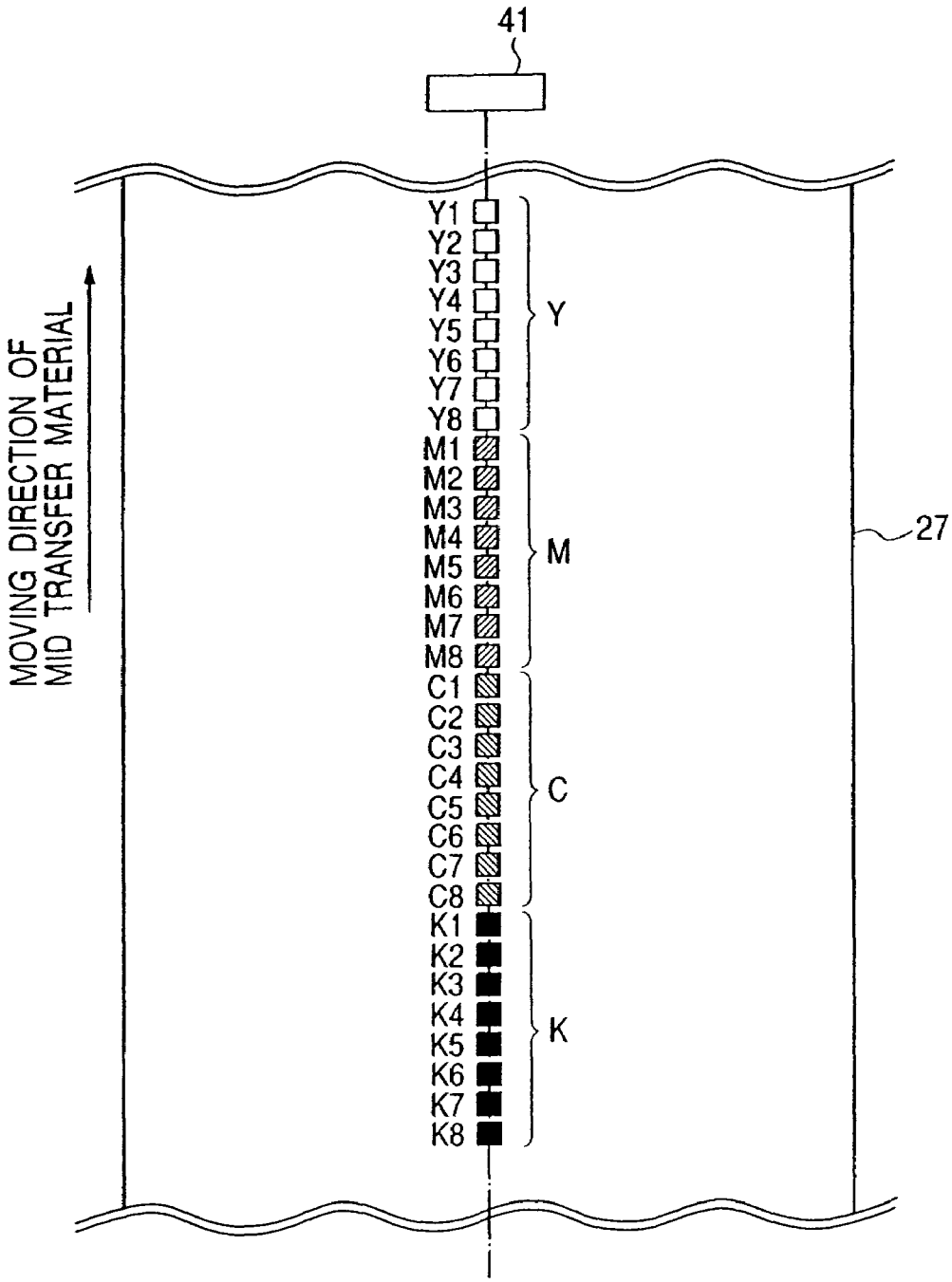
FIG. 10 is a view showing an arrangement of image gradation control patches in the first embodiment.

FIG. 10 shows a patch pattern formed on the intermediate transfer member, and, corresponding to the position of the density sensor 41, 8 mm square patches are formed with a gap of 2 mm and, for each of Y, M, C, K with an image print rate (density tonality) in 8 levels (8 patches for each color), thus 32 patches in total. In the present embodiment, the patches are formed with following print rates (tonality values): Y1, M1, C1, K1=12.5%; Y2, M2, C2, K2=25%; Y3, M3, C3, K3=37.5%; Y4, M4, C4, K4= 50%; Y5, M5, C5, K5=62.5%; Y6, M6, C6, K6=75%; Y7, M7, C7, K7=87.5%; and Y8, M8, C8, K8=100%.

Then a step S408 causes the density sensor 41 to detect the density of such patches. In this operation, the density output of the density sensor 41 is corrected by the density sensor correction table C901 shown in FIG. 9.

Then a step S409 executes an image tone control (tone correction), which will be explained in the following with reference to FIG. 11. In the following there will be only explained the tone control for cyan color, but the correction is executed also for magenta, yellow and black colors in a similar manner.

Figure 11:
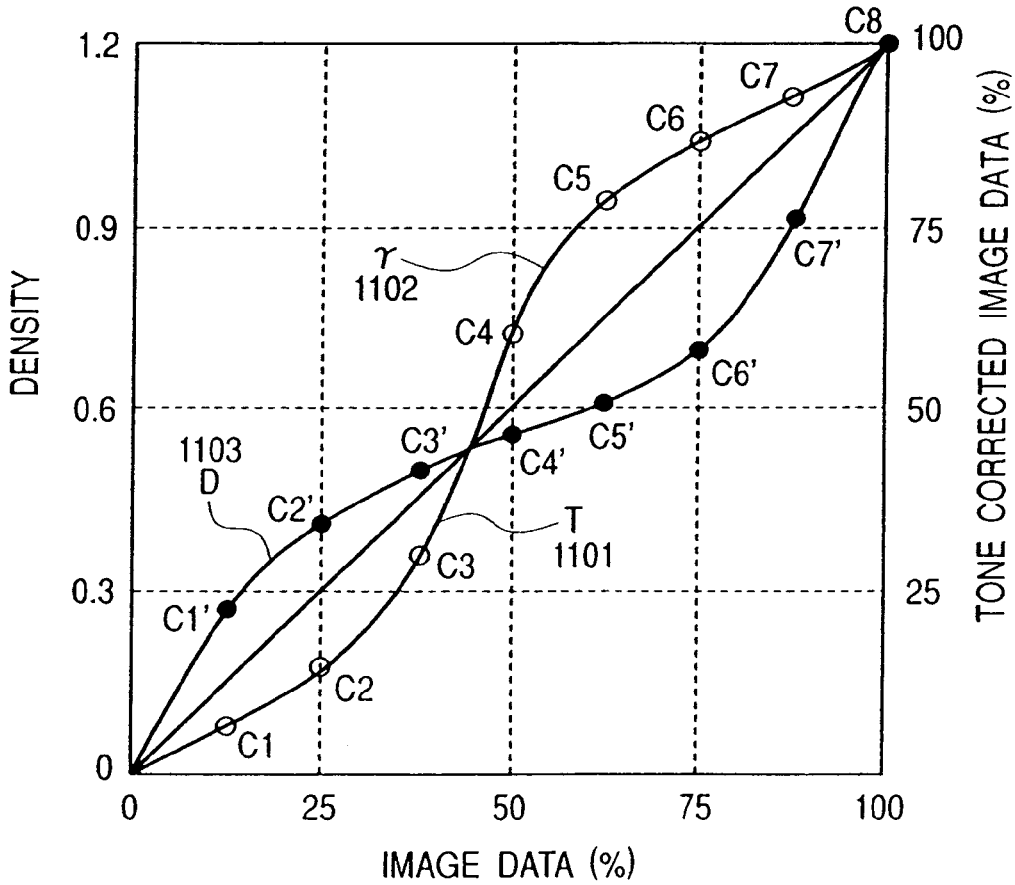
FIG. 11 is a chart showing an image gradation controlling method in the first embodiment.

Referring to a chart shown in FIG. 11, the abscissa represents a tonality value of the image data, while an ordinate represents a detected density (detection value corrected by the correction table). Also an ordinate represents a tonality value of the image data after tone correction.

In FIG. 11, each of white circles C1, C2, C3, C4, C5, C6, C7, C8 indicates an output density of the density sensor 41 corresponding to each patch. A straight line T 1101 indicates a target density-tone characteristics of the image density control. In the present embodiment, the target density-tone characteristics is so determined that the image data and the density are proportional. A curve γ 1102 represents density-tone characteristics in a state where the density control (tone correction control) is not executed. Densities of tonality levels not corresponding to patches are calculated by such a spline interpolation as to pass through the original point and the points C1 to C8.

A curve D1103 represents a tone correction table calculated in the present control, and is calculated by determining points symmetrical to the tone characteristics γ 1102 with respect to the target tone-characteristics T 1101. The tone control table D1103 is calculated by the unrepresented image processing unit 120, and is stored in the gamma correction unit 112 (utilizing a non-volatile memory in the present embodiment) in the image processing unit 110. In printing an image, the target tone characteristics can be obtained by correcting the image data with the tone correction table D1103.

In the following, there will be given a more specific explanation on the correction method for the image data, utilizing the tone correction table D1103 at the print image formation. For example, let us consider a C4 patch shown in FIG. 11. The C4 patch before correction has a density of about 0.7 for a print rate (tonality) of 50%. Since the target density for the C4 patch is 0.6 according to the straight line T1101, there is required a tone control of about 0.1. On the image data axis 1105 of the tone correction table D1103, a tonality of 50% provides a point C4' which corresponds to a tonality of about 46% on the image data axis 1106 after the tone correction, thus providing the tonality after the correction. It is thus identified that, for the patch C4, the formation of the print image should be made by correcting the tonality from 50% to 46%.

The corrections for the density sensor and for the color balance in the present embodiment are executed as explained in the foregoing.

The image tone control (tone correction) explained in the steps S407 to S409 is executed periodically, utilizing the density sensor 41. The output of the density sensor is corrected every time by the already calculated correction table C901. In the color image forming apparatus of the present embodiment, the image tone control (tone correction) is executed when the power supply is turned on, also when a developing apparatus or a photosensitive drum is replaced, and after printing operations of a predetermined number, namely in a situation where a density variation is anticipated. The apparatus can always maintain a satisfactory color balance by executing such image tone control (tone correction) periodically.

Also in case a variation in the transfer condition or in the fixing condition is anticipated (for example, when an intermediate transfer member or a fixing apparatus is replaced or when a installed location of the apparatus, namely an environment of use thereof, is changed), the user executes the aforementioned correction of the color sensor 42 (by the aforementioned steps S401 to S406), thereby renewing the correction table C901.

In this manner it is rendered possible to reduce the number of execution of the density control utilizing the color sensor thereby suppressing the consumption of the transfer material, and to provide a color image forming apparatus superior in the density stability in comparison with a prior density control utilizing only a density sensor.

The present embodiment has been explained by a color image forming apparatus utilizing an intermediate transfer member, but the present invention is applicable also to color image forming apparatus of other configurations. For example, the present invention is applicable also to a color image forming apparatus in which a toner image on a photosensitive member is directly transferred to a transfer material supported on a transfer material carrying member (such as a transfer belt) and which executes a density control by forming a toner patch on the transfer material carrying member.

As explained in the foregoing, the present embodiment allows to suppress the consumption of the transfer material, and to provide a color image superior in the density stability in comparison with a prior density control utilizing only a density sensor, by forming a mixed toner image containing a cyan toner, a magenta toner and a yellow toner on a transfer material, detecting the reflective characteristics of the mixed toner image with a color sensor, calculating a toner mixing ratio for bringing the mixed toner image to a achromatic state based on the result of such detection, detecting a density of a monochromatic toner image corresponding to the calculated toner mixing ratio by a density sensor, executing a correction of the density sensor based on the result of such detection and further executing an image tone control (tone correction) utilizing the density sensor.

(Second Embodiment)

In this embodiment, there will be explained a method of simultaneously forming patches of two kinds to be used for correcting the density sensor, namely patches for detection by the color sensor and patches for detection by the density sensor, thereby reducing a correction time for the density sensor and improving a precision of correction of the density sensor.

The present embodiment is an extension of the first embodiment, and is different therefrom in a timing and a pattern of formation of the patches to be detected by the density sensor for the correction thereof, and in a method for calculating the sensor correction table. An entire configuration of the color image forming apparatus to be employed in the present embodiment is similar to that of the color image forming apparatus explained in FIG. 1, and will not, therefore, be explained further.

Figure 12:
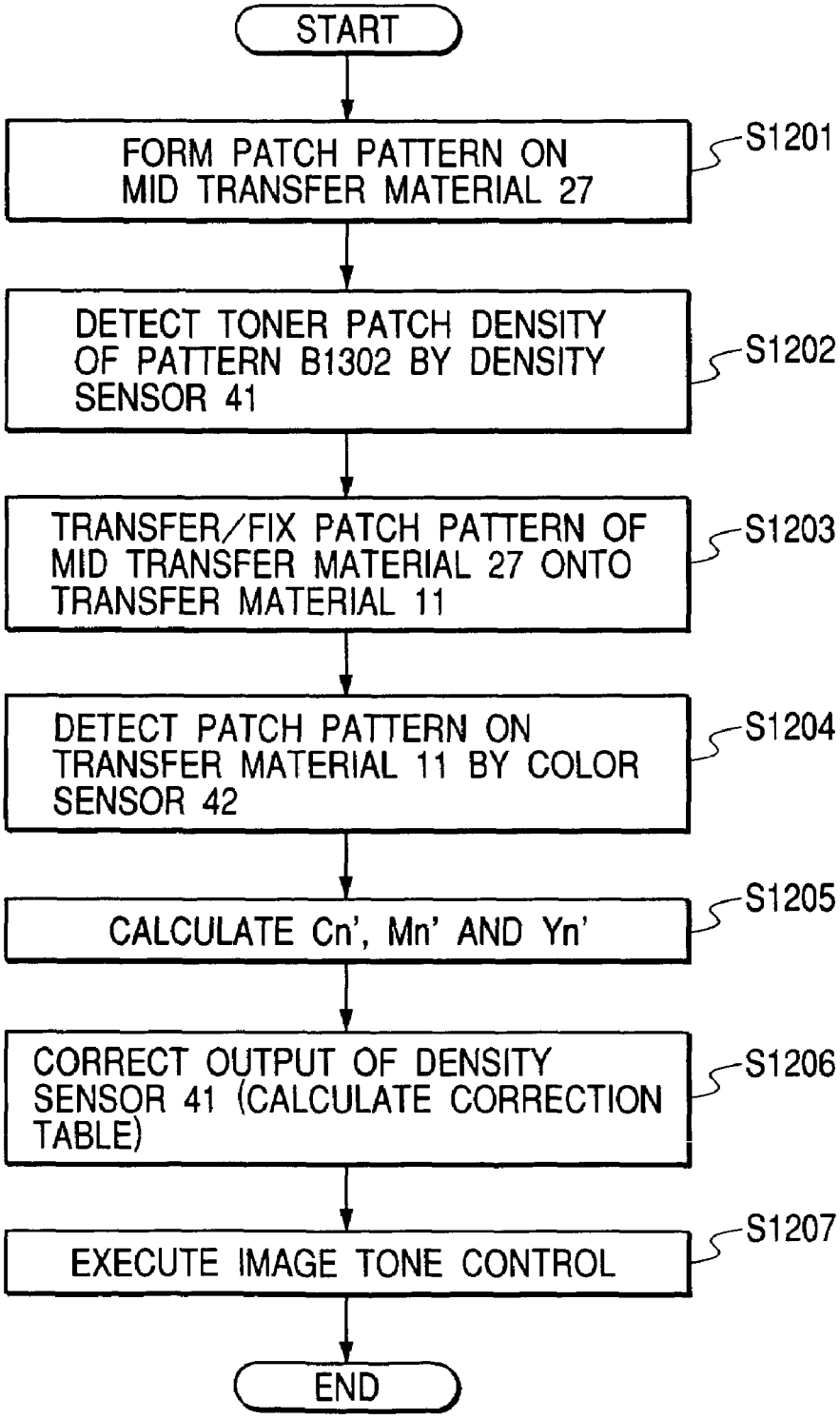
FIG. 12 is a flowchart showing a process in a second embodiment of the present invention.

In the following there will be explained, with reference to a flowchart shown in FIG. 12, correction methods for the density sensor and for the color balance in the present embodiment.

Figure 13:
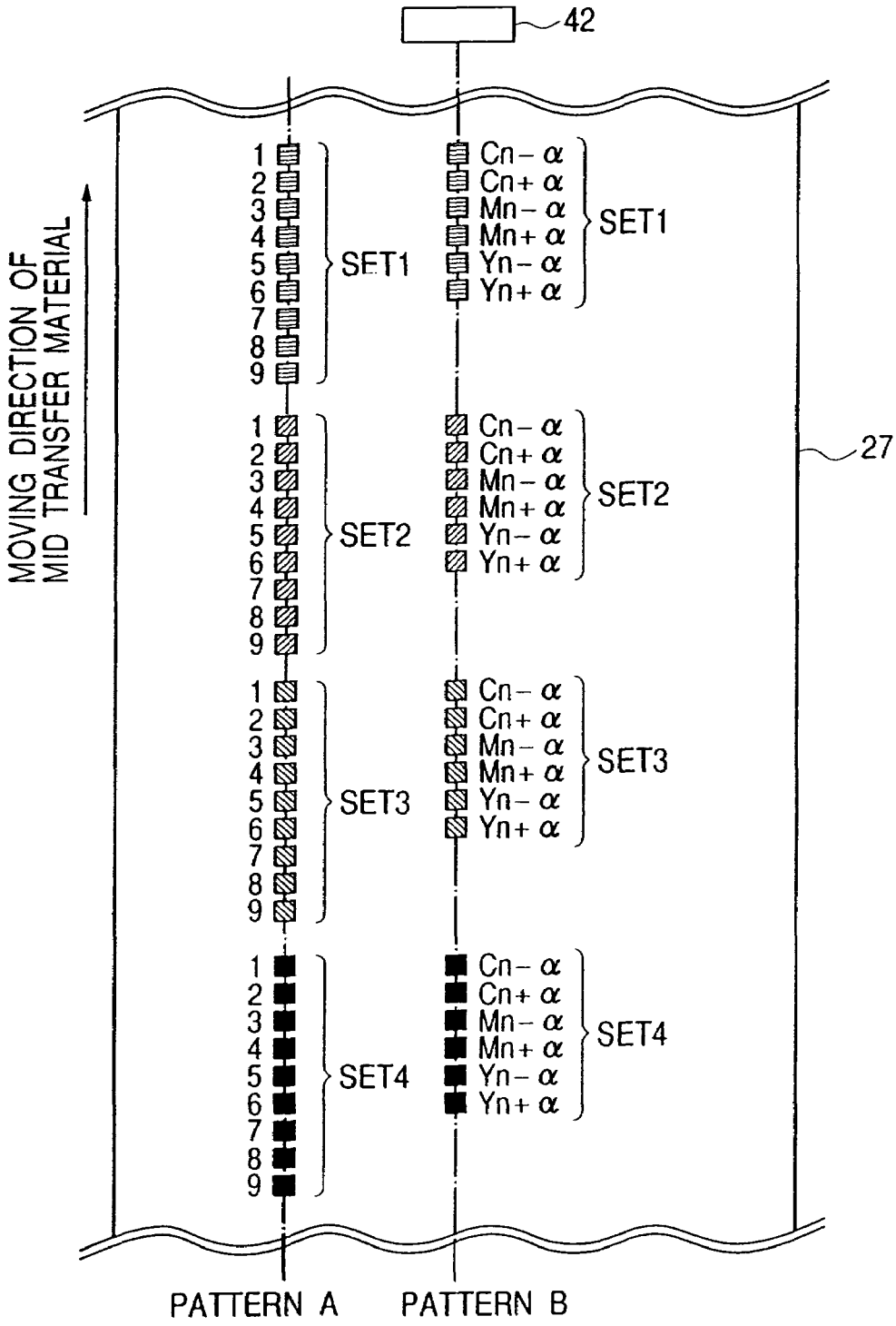
FIG. 13 is a view showing density sensor correcting patches in the second embodiment.

At first, a step S1201 forms a patch pattern on the intermediate transfer member 27. FIG. 13 shows the patch pattern, formed on the intermediate transfer member 27 and including a pattern A1301 for detection by the color sensor and a pattern B1302 for detection by the density sensor. The pattern B1302 is so positioned as to correspond to the detecting position of the density sensor 41, while the pattern A1301 is so positioned, when the pattern on the intermediate transfer member 27 is transferred onto a transfer material, as to correspond to the detecting position of the color sensor 42.

The pattern A1301 is composed of four patch sets (SET1, SET2, SET3, SET4), and each patch set is composed of CMY mixed-color patches 1 to 8 and a K monochromatic patch 9, namely 9 patches in total.

The patches 1 to 9 in a same patch set respectively have CMY data 1–8 and K monochromatic data 9 as shown in FIG. 6.

In a patch set SETn (n being 1 to 4), C, M, Y tonalities corresponding to the patches are a combination of values obtained by changing the tonality by $\pm\alpha$ from reference tonalities Cn, Mn, Yn (hereinafter represented as reference values). Also a 9th patch is a K monochromatic patch, formed with a predetermined tonality Kn. The reference values Cn, Mn, Yn and Kn are such that a mixing of Cn, Mn and Yn provides a color same as Kn in a state where the tone-density characteristics of C, M, Y and K are adjusted to a default state (most average state of the apparatus), and are selected in designing of color processing and halftone.

The patch sets SET1–SET4 are formed with different tonality values. More specifically, the SET1, SET2, SET3 and SET4 are prepared, for example, with the tonality of the Kn (patch 9) respectively at 25%, 50%, 75% and 100%. Also patches 1–8 are prepared with values corresponding to the tonality of Kn (patch 9).

The pattern B1302 is formed by monochromatic component patches (monochromatic patches) of the CMY mixed patches in the pattern A1301. More specifically it is composed of four tonality sets SET1, SET2, SET3 and SET4, and each tonality set includes 6 monochromatic patches of $Cn-\alpha$, $Cn+\alpha$, $Mn-\alpha$, $Mn+\alpha$, $Yn-\alpha$, and $Yn+\alpha$, corresponding to such tonality.

Then, in a step S1202, the density sensor 41 detects the patch density of the pattern B1302 formed on the intermediate transfer member 27 in the step S1201. Then a step S1203 transfers the patch pattern from the intermediate transfer member 27 to the transfer material 11 and executes a fixation by the fixing unit 30.

Then, in a step S1204, the color sensor 42 detects the RGB outputs of the patches of the pattern A1301 fixed on the transfer material 11 in the step S1203. Then a step S1205 calculates, based on the RGB outputs of the color sensor 42, C, M, Y values (tonalities) required for matching the C, M, Y process gray color with the K color of the patch 9, namely Cn', Mn' and Yn' values. A method for calculating the Cn', Mn' and Yn' values is similar to that in the first embodiment and will not be explained further.

A next step S1206 executes a correction on the output of the density sensor 41. In the present embodiment, different from the first embodiment, the patches for detection by the color sensor and the patches for detection by the density sensor are formed simultaneously, so that the Cn', Mn' and Yn' values are not determined at the formation of the patches for detection by the density sensor. It is therefore necessary to estimate, by calculation, the detection values of the Cn', Mn' and Yn' patches by the density sensor.

In the following there will be explained, with reference to FIG. 14, a method for estimating the detection values of the density sensor for the Cn', Mn' and Yn' patches. In the following there will be explained a method for a tonality level of Cn' (value for cyan toner), but a similar method can be used for other tonality levels or for magenta or yellow toner.

Figure 14:
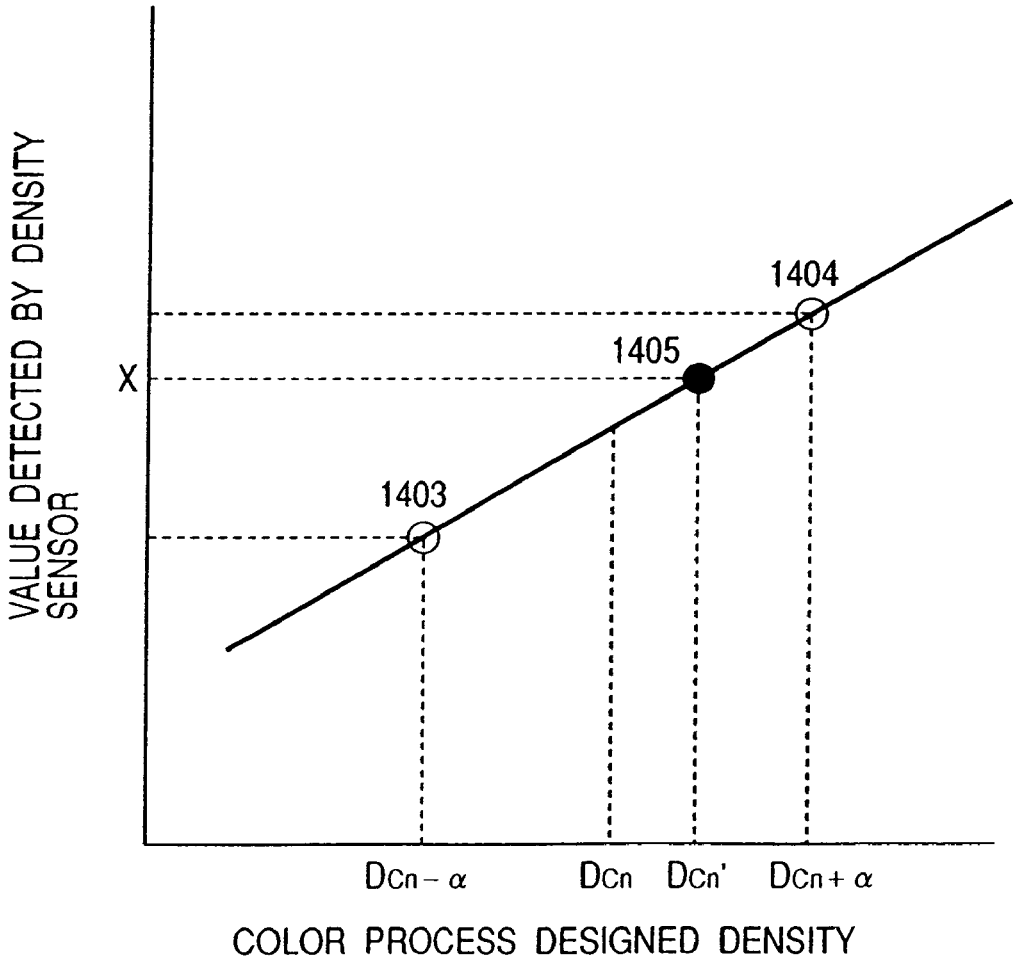
FIG. 14 is a chart showing a process for estimating a detection value of the density value for the patches in the second embodiment.

Referring to FIG. 14, the ordinate represents a detection result of the density sensor 41 on a patch, while the abscissa represents toner densities corresponding to $Cn-\alpha$, Cn and $Cn+\alpha$ when the apparatus is in a most average state, namely densities corresponding to $Cn-\alpha$, Cn and $Cn+\alpha$ at the designing of the color processing.

In FIG. 14, white circle points 1403 and 1404 indicate the detection densities of the density sensor 41 for the patches $Cn-\alpha$ and $Cn+\alpha$. An estimated detection value of the density sensor for a patch Cn' is calculated by a linear interpolation. More specifically, a value of a point 1405 is calculated on a straight line connecting the points of $Cn-\alpha$ and $Cn+\alpha$.

Thus, in FIG. 14, the detection value of the density sensor for the Cn' patch is given by X. Such calculation allows to provide the detection values of the density sensor for the Cn', Mn', Yn' patches.

Then a correction table C for the density sensor 41 is calculated, utilizing the values calculated by the above-described method (estimated detection values of the density sensor for the Cn', Mn', Yn' patches at each tonality. The correction table is calculated in a similar manner as in the first embodiment.

Then a step S1207 executes an image tone control (tone correction) utilizing the density sensor 41, thereby correcting the color balance. The image tone control (tone correction) is similar to that in the first embodiment. More specifically, patches of image print rates (density tonality values) varied in 8 levels are formed on the intermediate transfer member 27, then the densities of the patches are detected by the density sensor 41, and a tone correction table D is calculated based on the result of detection.

The corrections for the density sensor and for the color balance in the present embodiment are executed as explained in the foregoing.

The image tone control (tone correction) is executed periodically, utilizing the density sensor 41. The output of the density sensor is corrected every time by the table C. Also in case a variation in the transfer condition or in the fixing condition is anticipated, the user executes the aforementioned correction of the color sensor 42, thereby renewing the correction table C.

In this manner, it is rendered possible to reduce the number of execution of the density control utilizing the color sensor thereby suppressing the consumption of the transfer material, and to provide a color image forming apparatus superior in the density stability in comparison with a prior density control utilizing only a density sensor.

The present embodiment is suitable and effective in a color image forming apparatus capable of simultaneously forming two types of patches to be used for correcting the density sensor, namely the patches for detection by the color sensor and the patches for detection by the density sensor, namely a color image forming apparatus utilizing an intermediate transfer member as in the present embodiment.

Also the present embodiment, adapted to simultaneously form the patches for detection by the color sensor and the patches for detection by the density sensor, when applied to an image forming apparatus showing a significant variation in the density for example after a prolonged pause, can avoid the influence of density variation in time between the patches of two types (patches for detection by the color sensor and patches for detection by the density sensor), thereby allowing to improve the precision of correction of the density sensor and to further stabilize the color balance.

As explained in the foregoing, the present embodiment is capable, by simultaneously forming the patches of two types used for correcting the density sensor, namely patches for detection by the color sensor and patches for detection by the density sensor, of reducing the time required for correcting the density sensor and improving the precision of correction thereof.

In the first embodiment and the second embodiment, the output density value of the density sensor is corrected by the correction table C901, but, in case a density conversion table is provided in advance for the relationship between the output voltage of the density sensor and the density, it is also possible to apply the correction table C901 to such density conversion table thereby preparing a new density conversion table.

Also in the first embodiment and the second embodiment, there has been explained a case of utilizing a density as the optical reflection characteristics at the detection of the toner patch by the density sensor, but the optical reflection characteristics to be detected by the density sensor is not limited to such case, and it is also possible, for example, to utilize a color hue, an optical reflectance or a toner amount (toner weight) calculated from the optical reflectance. Stated differently, the present invention naturally includes the detection by an optical sensor of any physical amount convertible from the optical reflection characteristics of the toner patch.

(Other Embodiments)

The present invention is applicable not only to a system formed by plural equipment (for example a host computer, an interface device, a reader, a printer, etc.) but also to an apparatus formed by a single equipment (for example, a copying machine, a facsimile apparatus, etc.).

Also the objects of the present invention can naturally be attained also in a case where a memory medium (or a recording medium) storing program codes of a software realizing the functions of the aforementioned embodiments is supplied to a system or an apparatus and a computer (or CPU or MPU) of such system or apparatus reads and executes the program codes stored in the memory medium. In such case, the program codes themselves realize the functions of the aforementioned embodiments, and the memory medium storing the program codes constitute the present invention. The present invention naturally includes not only a case where the functions of the aforementioned embodiments are realized by the execution of the read program codes by the computer, but also a case where an operating system (OS) or the like functioning on the computer executes all the actual processes or a part thereof under the instructions of the program codes thereby realizing the functions of the aforementioned embodiments.

Further, the present invention naturally includes a case where program codes read from the memory medium are written into a memory provided in a function expanding card inserted into the computer or in a function expanding unit connected to the computer and a CPU or the like provided in such function expanding card or function expanding unit executes all the actual processes or a part thereof under the instruction of such program codes thereby realizing the functions of the aforementioned embodiments.

According to the embodiments explained in the foregoing, it is rendered possible to suppress the consumption of the transfer material required for the density control and to obtain a color image with superior density stability in comparison with the prior density control utilizing the density sensor only.

It is also rendered possible to reduce the time required for correction of the density sensor and to improve the precision of correction therefor.

The present invention has been explained by certain preferred embodiments, but the present invention is not limited to such embodiments and is subject to various modifications and applications within the scope and spirit of the appended claims.

What is claimed is:

1. A color image forming apparatus comprising:

an image forming unit, which forms a color image;

a first detector capable of detecting a density of an unfixed toner image;

a second detector capable of detecting a color of a fixed toner image;

a calculation unit adapted to calculate a condition that a patch of mixed toners becomes achromatic based on a detection result of the patch of mixed toners by said second detector;

a controller, which causes said image forming unit to form a patch of mono toner, based on a calculation result of said calculation unit; and a setting unit adapted to set a correcting condition for an output of said first detector, based on a detection result of the patch of mono toner by said first detector.

2. An apparatus according to claim 1, further comprising:

a second setting unit adapted to set an image processing condition based on an output of said first detector, corrected by a correcting condition set by said setting unit when said first detector detects the patch of mono toner.

3. An apparatus according to claim 2, wherein said image processing condition is a look-up table for each toner.

4. An apparatus according to claim 1, wherein said calculation unit calculates a color mixing rate at which the patch of mixed toners becomes achromatic.

5. An apparatus according to claim 1, wherein said calculation unit calculates a condition that the patch of mixed toners becomes achromatic, based on a detection result of a patch of achromatic toner by said second detector.

6. A color image forming apparatus comprising:

an image forming unit, which forms a color image;

a first detector capable of detecting a density of an unfixed toner image;

a second detector capable of detecting a color of a fixed toner image;

a calculation unit adapted to calculate a condition that a patch of mixed toners becomes achromatic based on a detection result of the patch of mixed toners by said second detector; and a setting unit adapted to set a correcting condition for an output of said first detector, based on a calculation result of said calculation unit.

7. An apparatus according to claim 6, wherein said setting unit sets a correcting condition for an output of said first detector, based on a calculation result of said calculation unit and a detection result of a patch of mono toner by said first detector.

8. An apparatus according to claim 6, further comprising:

a second setting unit adapted to set an image processing condition based on an output of said first detector, corrected by a correcting condition set by said setting unit when said first detector detects the patch of mono toner.

9. An apparatus according to claim 8, wherein the image processing condition is a look-up table for each toner.

10. An apparatus according to claim 6, wherein said calculation unit calculates a color mixing rate at which the patch of mixed toners becomes achromatic.

11. An apparatus according to claim 6, wherein said calculation unit calculates a condition that the patch of mixed toners becomes achromatic, based on a detection result of the patch of mixed toners and a patch of achromatic toner by said second detector.

12. A control method for controlling a color image forming apparatus, which forms a color image, the apparatus being provided with a first detector capable of detecting a density of an unfixed toner image and a second detector capable of detecting a color of a fixed toner image, the method comprising:

a step of detecting, by said second detector, a patch of mixed toners;

a step of calculating a condition that the patch of mixed toners becomes achromatic, based on a detector result of the patch of mixed toners by said second detector;

a step of causing said image forming unit to form a patch of mono toner, based on a result of said calculating step;

a step of detecting, by said first detector, the patch of mono toner, and a step of setting a correcting condition for an output of said first detector, based on a detection result of the patch of mono toner by said first detector.

13. A method according to claim 12, further comprising:

a step of setting an image processing condition based on an output of said first detector, corrected by a correcting condition set by said setting step when said first detector detects the patch of mono toner.

14. A method according to claim 13, wherein the image processing condition is a look-up table for each toner.

15. A method according to claim 12, wherein said calculation step calculates a color mixing rate at which the patch of mixed toners becomes achromatic.

16. A method according to claim 12, wherein said calculation step calculates a condition that the patch of mixed toners becomes achromatic, based on a detection result of the patch of mixed toners and a patch of achromatic toner by said second detector.

17. A control method for a color image forming apparatus which forms a color image, the apparatus being provided with a first detector capable of detecting a density of an unfixed toner image and a second detector capable of detecting a color of a fixed toner image, the method comprising:

a step of detecting, by said second detector, a patch of mixed toners;

a step of calculating a condition that the patch of mixed toners becomes achromatic, based on a detection result of the patch of mixed toners by said second detector; and a step of setting a correcting condition for an output of said first detector, based on a result of said calculating step.

18. A method according to claim 17, wherein said setting step sets a correcting condition for an output of said first detector, based on a calculating result of said calculating step and a detection result of the patch of mono toner by said first detector.

19. A method according to claim 17, further comprising:

a step of setting an image processing condition based on an output of said first detector, corrected by a correcting condition set by said setting step when said first detector detects the patch of mono toner.

20. A method according to claim 19, wherein the image processing condition is a look-up table for each toner.

21. A method according to claim 17, wherein said calculation step calculates a color mixing rate at which the patch of mixed toners becomes achromatic.

22. A method according to claim 17, wherein said calculating step calculates a condition that the patch of mixed toners becomes achromatic, based on a detection result of the patch of mixed toners and a patch of achromatic toner by said second detector.

* * * * *

UNITED STATES PATENT AND TRADEMARK OFFICE

CERTIFICATE OF CORRECTION

PATENT NO. : 6,985,678 B2
APPLICATION NO. : 10/653944
DATED : January 10, 2006
INVENTOR(S) : Yoichiro Maebashi et al.

It is certified that error appears in the above-identified patent and that said Letters Patent is hereby corrected as shown below:

Column 1,
Line 26, “result” should read -- result in --; and
Line 44, “coped” should read -- copied --.

Column 3,
Line 4, “accompanying” should read -- the accompanying --.

Column 5,
Line 52, “reflectedlight” should read -- reflected light --; and
Line 54, “charge-accumulatingsensor” should read -- charge-accumulating sensor --.

Column 7,
Line 56, “(8α3)” should read -- (8α3)) --.

Column 8,
Line 3, “should” should read -- should be --; and
Line 57, “in more” should read -- in a more --.

Column 9,
Line 46, “ordinate” should read -- ordinate 1106 --.

Column 11,
Line 57, “in” should read -- in the --.

Column 13,
Line 54, “case,” should read -- a case, --.

UNITED STATES PATENT AND TRADEMARK OFFICE

CERTIFICATE OF CORRECTION

PATENT NO. : 6,985,678 B2
APPLICATION NO. : 10/653944
DATED : January 10, 2006
INVENTOR(S) : Yoichiro Maebashi et al.

It is certified that error appears in the above-identified patent and that said Letters Patent is hereby corrected as shown below:

Column 15,
Line 54, “toner, and” should read -- toner; and --.

Signed and Sealed this

Eleventh Day of July, 2006

JON W. DUDAS
*Director of the United States Patent and Trademark Office*